US007977561B2

(12) United States Patent
Folkesson

(10) Patent No.: US 7,977,561 B2
(45) Date of Patent: Jul. 12, 2011

(54) MODULAR KEYBOARD SYSTEM

(76) Inventor: John Folkesson, Stockholm (SE)

( * ) Notice: Subject to any disclaimer, the term of this patent is extended or adjusted under 35 U.S.C. 154(b) by 195 days.

(21) Appl. No.: 12/355,763

(22) Filed: Jan. 17, 2009

(65) Prior Publication Data

US 2009/0188378 A1 Jul. 30, 2009

Related U.S. Application Data

(60) Provisional application No. 61/024,281, filed on Jan. 29, 2008, provisional application No. 61/027,489, filed on Feb. 11, 2008.

(51) Int. Cl.
*G10H 1/00* (2006.01)

(52) U.S. Cl. ..... 84/615

(58) Field of Classification Search ..... 84/615, 84/478

See application file for complete search history.

(56) References Cited

U.S. PATENT DOCUMENTS

| | | | | |
|---|---|---|---|---|
| 6,875,913 | B2 | 4/2005 | Bubar | |
| 2005/0241467 | A1* | 11/2005 | Lo | 84/744 |
| 2005/0257228 | A1* | 11/2005 | Ono et al. | 719/331 |

FOREIGN PATENT DOCUMENTS

| | | | |
|---|---|---|---|
| JP | 9258733 | A | 10/1997 |
| JP | 2003-302975 | A | 10/2003 |
| JP | 2007-206163 | A | 8/2007 |

* cited by examiner

*Primary Examiner* — Jianchun Qin

(57) ABSTRACT

Disclosed is a modular electronic musical keyboard performance system that can be separated into modules for better portability and flexibility.

3 Claims, 10 Drawing Sheets

MODULAR KEYBOARD SYSTEM

This Application claims the benefit of U.S. Application Ser. No. 61/024,281 of JOHN FOLKESSON filed Jan. 29, 2008 for ELECTRONIC MUSICAL KEYBOARD WITH TACKTILE FEEDBACK, the contents of which are herein incorporated by reference. This Application claims the benefit of U.S. Application Ser. No. 61/027,489 of JOHN FOLKESSON filed Feb. 11, 2008 for ELECTRONIC MUSICAL KEYBOARD PERFORMANCE SYSTEM, the contents of which are herein incorporated by reference.

BACKGROUND OF THE INVENTION

1. Field of the Invention

This invention relates generally to systems and methods for generating musical pitches and, more particularly, to systems and methods for employing a modular keyboard assembly. The present invention relates to an electronic musical keyboard performance system that both flexible in configuration and more easily transported.

2. Description of Related Art

A major change in technology for keyboard musicians has been the introduction of electronic keyboards. This has allowed musicians to carry their instruments to the performance venue as opposed to only being able to play venues that had pianos, organs or other acoustic keyboard instruments set up. While a typical electronic key-board is more portable than a piano, it is still dimensioned rather awkwardly. It cannot for instance be carried on an airplane being far too long.

There have been a number of patents addressing this issue. They all involve splitting the keyboard along its length into smaller sections. These then can be made to fold upon one another or to separate completely. They differ mainly in the specification of the means for connection, the signal bus, the functionality included and how that functionality is distributed in the system. There is now some prior art on the means for connection of keyboard modules. Some have specified that the keyboard never completely separates but is rather collapsed into a folded position. Others have sections which separate and are specific about the alignment of the separate sections in order to join them into a single, rigid, and strong keyboard or about some other aspect of the keyboard such as the communication of data between modules. Some have specified that sound generation and other functions be incorporated into the keyboard modules.

Some of the issues regarding the means for connection are alignment, structural integrity, limitations on manufactured tolerances, and the distribution of large stresses that can develop at the joint. A keyboard instrument used by a performing musician will need to be transported, setup, banged on, and packed up many times. Musicians have the experience of single piece keyboards not holding up well to this. They are quite correctly wary of keyboards that are in multiple pieces.

On the issue of alignment, the keyboard modules must join in a tight alignment with the tolerance in spacing between the keys across the join around 0.2 mm, (the spacing being about 1 mm). This separation must be maintained while the musician is playing the keyboard and perhaps leaning his or her weight on it. The keyboard will typically be supported by a keyboard stand on the ends and the middle section will then feel a force of the total keyboard weight plus the force applied by the performer leveraged by the distance from the join to the support. That distance can be about 80 cm. If the keyboard is held in this way and the musician plays it with vigorous force or even leans all his or her weight on the keyboard it should not bend or break. A design that has this bending torque countered by a short alignment plug and latch will find the latch can have as much as a ton of force applied to it under the load of a man leaning all his weight on the center off the keyboard.

The separation of the keyboard into modules that produce no sound might require some inter module communication that can carry information on key press velocity from each module to a generator of musical tones corresponding to the key and velocity. In U.S. Patent Application 20050241467 a modular keyboard with a bus that connects the modules includes separate dedicated lines to each single key switch. This idea is not very practical as the number of key switches is 2 per key and there can be 88 keys.

The prior art includes connecting a data bus across two modules by combining a male connector on one module to join to a female on the other (U.S. Pat. No. 6,875,913). This has the disadvantage of that under condition of relative movement between the two modules this male/female type connection would be directly stressed. This will lead to early failure of the electrical connector.

A further problem with current keyboard systems in general is the tendency to integrate more and more features into the keyboard. This is not a problem per se as it lowers the cost per feature when one wants all the features. The problem is that one may want only a subset of the features and that some of the features may not be satisfactory in quality for some uses. One is forced into a compromise of buying what one does not want. Also when any part of the keyboard wears out or becomes obsolete an entire system must be replaced. Many of the most expensive parts of the system might still be fine. So perhaps one key of the keyboard stops working. Either replacing the whole keyboard or sending the whole keyboard off for repair are both unappealing Typical of current stage keyboards is that it is difficult for the musician to find a keyboard that both has good key action and just that functionality that is needed. For instance, they may end up buying a keyboard with expensive sound generation capability but never use it as they have other sound generation devices that they prefer including virtual instruments running on a general purpose personal computer, (PC).

A number keyboards fold about some axis. These are all distinguished from keyboards comprised of detachable modules. The advantage of a modular over a folding design is twofold. One the modules can be transported separately as lighter parts, (keyboards can weigh up to 70 lbs or more) and two the hinges are a point of great stress and must be made exceedingly strong.

SUMMARY OF THE INVENTION

In accordance with an aspect of the present invention, there is a modular musical performance system comprising a plurality of first modules, each first module including a plurality of keys; a plurality of key switches that operate in response to the striking and releasing of the keys, wherein an arrangement of the keys is such that when connected to another first module the keys of the two modules form a section of a continuous music keyboard. The system also includes a plurality of second modules, each second module including a component selected from the group consisting of a performance controller, a computer interface, a musical tone generator, a musical accompaniment, a speaker, a performance recorder, an audio amplifier, an audio mixer, an audio processor, and a support extending to the floor, wherein the first and second modules are irremovably connectable to from a single rigid structure.

In accordance with another aspect of the present invention, there is a modular musical performance system comprising a computer interface that exchanges both performance data and digital audio between the system and a computer; and a plurality of first modules, each first module including a plurality of keys; a plurality of key switches that operate in response to the striking and releasing of the keys, wherein an arrangement of the keys is such that when connected to another keyboard module the keys of the two modules form a section of a continuous music keyboard, and wherein the first modules are irremovably connectable to from a single rigid structure.

In accordance with yet another aspect of the present invention, there is a modular musical performance system comprising a plurality of modules connected by a separate connection part where at least one module includes a plurality of keys; a plurality of key switches that operate in response to the striking and releasing of the keys, wherein an arrangement of the keys is such that when connected to another such keyboard module the keys of the two modules form a section of a continuous music keyboard, and wherein the modules are irremovably connectable to from a single rigid structure. The separate connection part when inserted into each module being capable of holding the modules in position relative to one another and of forming an electrical connection for passing signals.

BRIEF DESCRIPTION OF THE DRAWINGS

References are made to the following text taken in connection with the accompanying drawings, in which.

Figure 1:
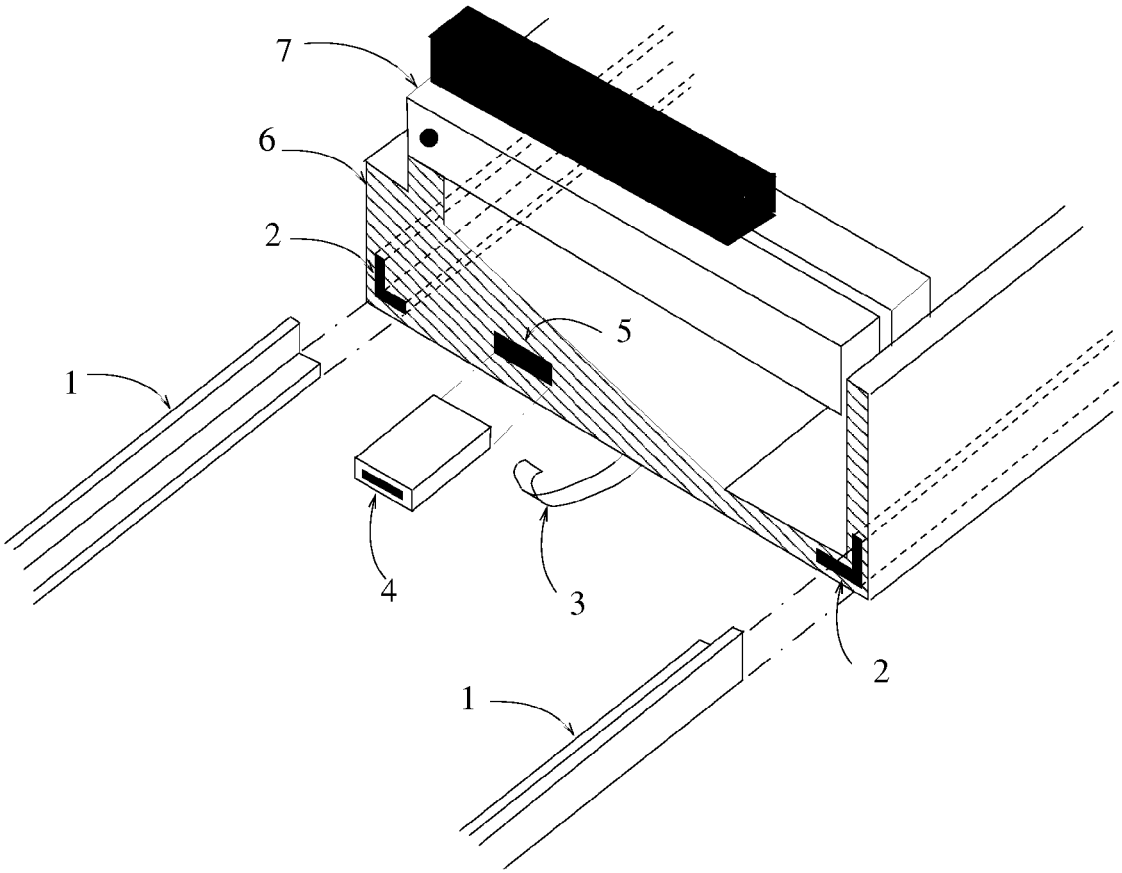
FIG. 1 shows a perspective view of an embodiment.

The accompanying drawings which are incorporated in and which constitute a part of this specification illustrate embodiments of the invention and, together with the description, explain the principles of the invention, and additional advantages thereof. Certain drawings are not necessarily to scale, and certain features may be shown larger than relative actual size to facilitate a more clear description of those features. Throughout the drawings, corresponding elements are labeled with corresponding reference numbers.

DETAILED DESCRIPTION OF EXEMPLARY EMBODIMENTS

The exemplary system comprises a number of physically separable modules that connect to form a single rigid structure. In the preferred embodiment we propose using one or more long alignment parts that can slide into channels in the modules on each side of the join line. The alignment parts can be as long as the assembled keyboard or as short as a single module length. In the later case it would extend half way into each module across the join. Then when the modules are separated it can be either packed separately or slid completely into one of the modules for transport. Thus we achieve a long alignment member without adding to the module length.

These alignment parts can be simply standard extruded aluminum angle bars which even at the full keyboard length are rather easy to transport being light, thin, rugged and inexpensive. The stresses will be distributed along the length of the alignment parts and thus will mostly bypass the modules.

The modules can be held together by any latching mechanism as the forces pulling them apart are now small. The large torque that would have acted to separate them is now carried along the length of the long alignment parts which gives a much smaller leverage.

The modules have a means for communication that is either a data bus with an electronic connection between modules or a wireless communication. The advantage of wireless is that the modules could be electrically isolated preventing ground loops. The advantage of a data bus is that the modules could share power and ground. The ground loop problem could be avoided by having the signal ground path pass between modules only through the data bus connection. Also a data bus allows the dedication of separate lines for separate functions such as performance data, power, ground, and audio. Another way to avoid the ground problems is to use a balanced signal connection where grounds do not need to be connected between modules at all. The data bus can be connected across the join of two modules by a separate connector part.

In an exemplary embodiment each keyboard module includes a key switch array. The key switch array would have data lines each running to the key switches and address lines running to the opposite poles of the switches. Both data lines and address lines can run to several switches each. The important restriction being that the path from any address line though the closed switches to any of the data lines is unique. That is, for any switch the pair of data and address lines attached to it will be connected only when that one switch is closed. Thus one can poll by setting a voltage on one address line and then seeing which if any of the data lines goes high.

The key switch array is either polled by a processor on each keyboard module or the key switch array bus itself is passed between modules to a module that contains the processor that does the polling. In the first case, which is the preferred method, the data on switch closing is converted into messages using some message protocol and sent over the means for communication. There could be a separate performance controller module that includes a processor listening to all the messages from all the modules and then translating them to another protocol such as midi which is understood by the sound generators and then sending the data to and output port. This separate module would also contain at least one other performance controller, such as sustain pedal, pitch bend, or modulation wheel. Alternatively the modules could produce midi signals directly and this could be the message protocol. Some other choices for the bus level hardware protocol comprise USART, USB, Firewire, or some Ethernet based protocols. These choices imply some other layer of protocol above this to handle the packaging of relevant messages into bit streams which could be that part of the midi protocol or some other protocol. There are a number of wireless protocols as well.

The only complication in the case of a data bus that comprises a shared message bus being that no two modules should write messages to the bus simultaneously. This can be avoided by having a write token passed over a separate line in the bus between the modules. This line could also then be used to sense the relative locations of the modules in the case that their relative positions along the keyboard are not fixed. The boot sequence could then determine the proper note number for each key. With this scheme many modules can share a single line of the bus for communication of performance data with very little latency.

By being able to swap the positions of the modules the keyboard will wear out more evenly. The keys in the middle being played much more than those on the ends of the keyboard. This would be analogous to rotating the tires on a car. The significance of this is that the keyboard will last longer.

Having a standard mechanical and electronic connection between modules allows the flexible integration of other useful functionality to the keyboard. Thus the musician might want to be able to plug a computer into the instrument. A separate module that includes a computer interfaces that could be integrated as an optional module. This could take many forms. One might be simple a midi output. In one embodiment, this module could have inputs for analog audio sources which would be converted to digital and sent to the computer along with the key data over a data cable. The module could receive similar digital audio and note data from the computer. The digital audio could be converted to analog and made available to the user via output jacks. The note data could be sent to other devices that could convert them to sound. The audio data could similarly be exchanged with other modules over the means for communication.

There are a multitude of possible functions that could be then manufactured as separate modules. These include a mixer that could allow combining and amplification of different sound modules and microphone inputs into a single stereo output and/or a headphone output. Another would be built in speakers converting audio signal to audible sound. Another would be signal processing with some audio input and output. Examples are as re-verb, equalization, delay, pitch shift, compression, chorus, or other. Another would be playback of musical accompaniment such as drum rhythms and harmony. Another would be recording and playback of the performance. This would include midi sequencers or audio recorders. These modules might utilize the data bus for communication and power. Alternatively they might be functionally independent and only mechanically coupled to the keyboard.

Another function is the generation of musical tones. There are a large number of technologies that are used to synthesize musical tones in response to a keyboard instrument's key velocity signals. Thus the possibility exists for an expandable keyboard where different sound modules can be added to the keyboard extending its length while providing the musician with new timbres. This without the expense of the keys themselves. Also one would have the new module integral to the keyboard on stage as opposed to inaccessible in a rack offstage.

Another functional module is a virtual instruments and effects playback module. It would contain a CPU running a modified operating system that could play back third party virtual sounds and effects written for a standard PC. This module would not require an ascii keyboard or monitor. It could be configured remotely at home via a PC with a full interface. A hard disk and fan would not be needed which would eliminate the problem of noise that these mechanical parts generate. They could be replaced by a flash drive or similar memory and low power processors with a passive cooling system (so called fanless computers). Then at the gigs one could call up the preset patches by simple midi program change messages or buttons on an interface panel. So it would function as a standard PC running music software but appear as an ordinary sound module that was integrated into the keyboard.

Several virtual instruments and effects playback modules could be attached to the system and they could communicate over the data bus to share the computational load acting as one unit with increased CPU power. The playback engine could distribute the load from one master module to several slave modules.

A pair of modules could be attached to each end of the keyboard to provide support in the form of legs.

More Detailed Description of Exemplary Embodiments

There are a number of embodiments of the invention of this application. They differ in what modules are included and the inter module communication. They all contain at least two keyboard modules with a plurality of keys and associated key switches. These are arranged to form a keyboard that is separated along its length dividing the keys between the modules. The keyboard modules all have a switch array bus including address lines and data lines each line being connected to at least one switch with the address lines attaching to one pole of the switches while the data lines attach to the other such that each switch is attached to exactly one data line and one address line and no data line is connected to the same address line via two different switches. The keys of the keyboard modules are mounted in such a way that they form a section of a continuous music keyboard formed when two or more keyboard modules are joined to one another. The prototypical music keyboard is laid out as on a piano.

There are three basic embodiments that further specify the basic system slightly differently.

In the first one there is a means for communication of messages between modules. There is also an active processor on each keyboard module that polls the switch array bus and converts the switch closing information into coded messages to be sent to an adjacent module using the means for communication. This embodiment would either contain a computer interface which exchanges performance data and digital audio with a computer or a plurality of functional modules besides the keyboard modules.

In the second basic embodiment there is a data bus conveying voltages and information between modules. There is also an electronic connection between the modules that allows the joining of lines of the data bus comprising a separate bus connection part. The lines of the switch array bus are directly connected to corresponding lines of the data bus. This then is polled by an active processor contained in a separate performance controller module. This information is then coded as performance data and sent to and output port as midi data as well as to the other modules over the data bus.

In the third, and preferred, basic embodiment there is a data bus conveying voltages and information between modules comprising a number of one or more message lines. There is also an electronic connection between the modules that allows the joining of lines of the data bus and comprising a separate bus connection part. There is also an active processor on each keyboard module that polls the switch array bus and converts the switch closing information into coded messages to be sent to an adjacent module using the message lines of the data bus. The alignment channels are also specified to pass completely through the modules. The message lines of the data bus can be combined with other data bus lines for voltages and information.

These three basic system embodiments can then be extended to form variations and extensions on the basic exemplary system. These all take the form of adding separate functional modules that conform to the connection standard and inter-module communication so that they can share both information with and be physically joined to the other modules. We will use 'communication channel' to refer to either the 'data bus' in the second and third embodiments or the 'means for communication' in the first embodiment. The communication channel can be used by the modules to send and receive data of relevance to that module. The embodiment with a data bus can also receive power and ground over the bus.

The list of possible functional modules include:

- A performance controller module to convert the key switch information from the the communication channel to a format suitable to be sent to a musical tone generator comprising an output port for the musical note data, a processor that communicates with the other modules over the communication channel, and at least one controller other than keys to generate musical performance data;
- A musical tone generator outputting audio based on the note data coming over the communication channel and including a processor that communicates with the other modules over the communication channel;
- An audio processor including an audio input and output;
- A signal mixer that mixes audio input signal and includes audio input and output;
- A signal amplifier that amplifies audio input signal and including audio input and output;
- A speaker module;
- A playing of musical accompaniment module;
- A recording and playback of the musical performance module;
- A pair of additional modules having legs that extend to the floor to support the keyboard;
- an interface to a computer that exchanges musical note information and digital audio and including a processor that communicates with the other modules over the communication channel;
- a dedicated virtual instrument and effects playback module that can playback third party virtual instruments written for a standard PC without needing the PC screen, keyboard, hard disk, and fan.

FIG. 1 is a perspective view of keyboard module (221), showing the first three keys. The module can have any number of keys. For example, 12 keys gives a complete octave 24 keys gives two octaves and so on. The key pattern repeats every octave so that by having the modules be multiples of 12 keys one can join them in any order. The modules are held together by a draw latch (3). The key switches and electronics are not shown in FIG. 1 but would be situated below the keys so that pressing the keys would activate the switches. The switches could be rubber membrane switches directly on a printed circuit board mounted below the keys.

The left end face of a module is shown in FIG. 1. The right end would look like a mirror image aside from the difference in the pattern of the keys (7) and the latch (3). This would then allow a number of these modules to be joined. The alignment parts (1) slide into the alignment channels (2). These channels run the length of the module and open on both ends. The alignment parts (1) can then be longer than the module extending into the modules on either side of it. Alternatively the alignment parts (1) could be as long as a module and extend across the join and halfway into the modules on each side of it.

These alignment parts (1) can be made of aluminum. The main chassis (6) can be made of a combination of ABS plastic and aluminum. The keys (7) can be of ABS plastic. The alignment channels could be made with a constant cross section by plastic extrusion. At least one of the channel walls should form a lever pressing on the aluminum alignment part. This lever will be forced open by inserting the alignment part and then prevent the part from rattling in the channel. In this way the tolerance on the fit of the alignment part in the channel can be relaxed.

The bus connector part (4) joins the electronic data bus and fits symmetrically into connection (5). This can be a pair of connectors electrically joined inside of (4). The connection inside the modules at (5) would then consist of a mating element to the connector in (4).

Figure 2:
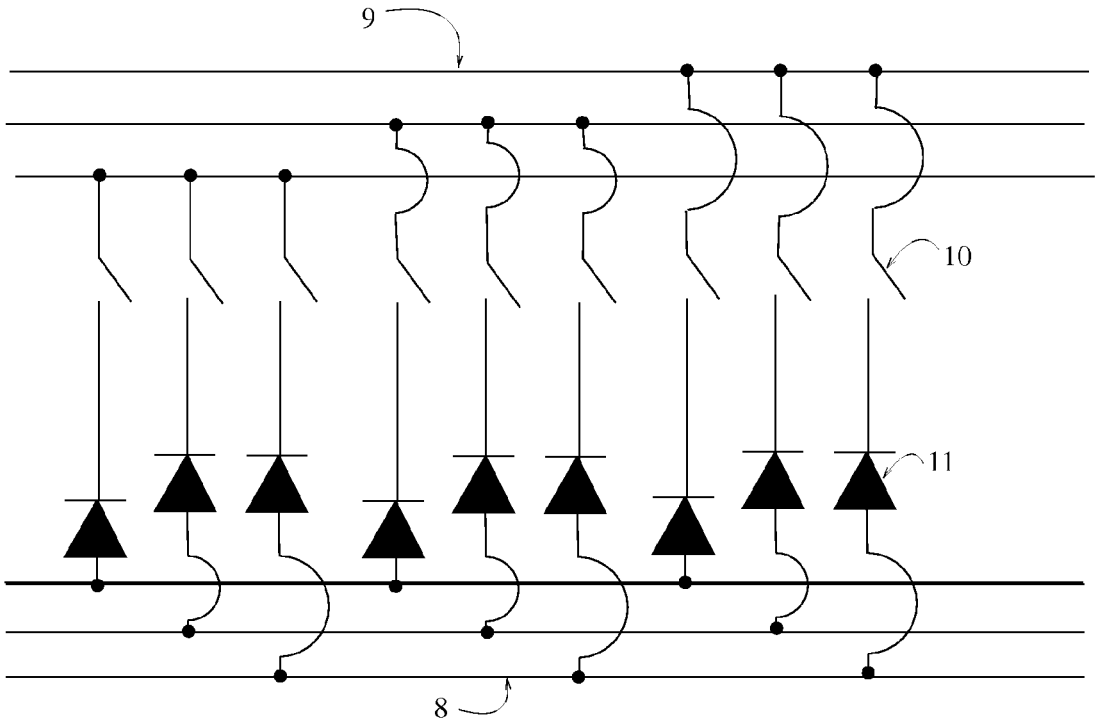
FIG. 2 shows an addressable key switch array.

The modular keyboard is equipped with a key switch array. This array is read by active circuits in the individual modules which then pass them to a data bus leading to the adjacent modules. A section of a typical addressed array bus is shown in FIG. 2. Here we show nine switches (10) which would be enough for 4.5 keys. Each key requires two switches to measure the key velocity. The two switches are made to close at different points along the key travel. By measuring the time difference between the switch closings one can measure the key velocity. In FIG. 2 The lower three lines (8) represent the address bus. By setting a positive voltage of a few volts on one of these while holding the other two address lines at ground one can test the data lines (9) for switch closure.

The passive diodes (11) prevent the voltage from the high address line from passing to the other address lines when a pair of switches are closed. In this case the nine switches are read with six lines. By continuing this pattern even more switches can be read.

Figure 3:
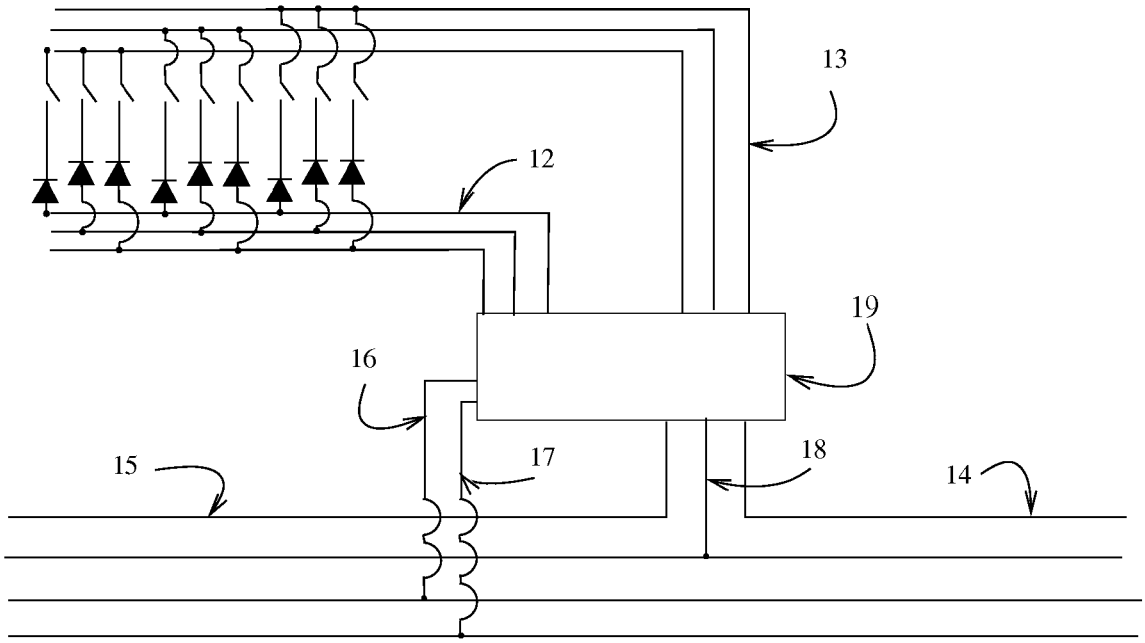
FIG. 3 shows a processor powered from the data bus and able to poll the address lines while reading the data lines.

In FIG. 3 an active processor element (19) is shown. The data bus here consists of lines 14 to 18. The data bus is four conductors wide with line (14) leading out to the adjacent module to the right while line (15) leads to the adjacent module to the left. This line can be used for token passing between the modules and for sensing the order of the modules from right to left. Thus a boot up sequence of operation can be used for each module to discover its position along the keyboard relative to the other modules. The transmit token is passed by setting line (14) high and the token is received by sensing line (15) high.

Line (16) could be used to provide voltage to power the processor circuits (19) while line (17) can be ground. Line (18) is used to carry serial data. The processor is switched between transmit and receive mode based on the token value and whether it has data to send. If it has no data to send when line (15) goes high it passes the token to the next module by setting (14) high. The last module in the chain can send a message over the data line (18) to transfer the token to the opposite end of the keyboard. Alternatives include doing all token passing over the message bus or introducing a fifth data bus line to return the token to the start.

An example of a boot sequence to determine the modules position could be as follows. The token lines (14) and (15) could have a pull up resistor holding them high if no signal is output. The processors each set the token line to their right (14) to low on boot-up. The processors after waiting for a sufficient time all check the token line to their left (15) and if it is high they are the leftmost module and can then send a message over the bus claiming the lowest N note numbers where N is the number of keys on the module. It then sets the token (14) to high allowing the next module to claim the note number it needs. After the rightmost module has claimed its note numbers there will be no new messages. After a timeout all the modules can adjust their note numbers to better center the keyboard range having listened to all the messages claiming note numbers. This will also have allowed the right most module to learn its special status as the turn around module that has to return the token each time. There are several other schemes for this.

Only a portion of the lines of the switch array are shown for the sake of clarity of the figure. The address lines (12) are polled by holding two lines at ground while the third is at a positive voltage. The line chosen is cycled at some frequency. The data lines (13) are then tested to see if any switches are closed. (19) might require a number of separate IC elements or be implemented as a single chip solution. Chips are available at costs that are comparable to the cost difference between a wider data bus connector and the four conductor connector needed here.

The modules are all equipped with two data bus connections (5) one on each end. The assembled keyboard will then have two unused connections. Either one of these can be used to attach an performance controller module. This module will connect like the others but will have a third connection, data out. This could be a standard midi connector and the signal could conform to the midi standard. This module will either do the active polling of the address bus or read the messages coming over the active bus. Either way it then translates the keyboard data to a form that is used by the musical tone generator. Currently the dominant format for this is midi data. There can be a number of additional user interface switches on this module allowing selection of such parameters as velocity curve, midi channel, split point, and transpose. This module will also provide pedal inputs for sustain or volume. Other common midi controllers could be added such as pitch bend and modulation wheel. It would additionally have a data in port which could be a midi in port. It could also have a midi thru port. Other ports on this module could be a USB or firewire port to hook up a computer to it.

Figure 4:
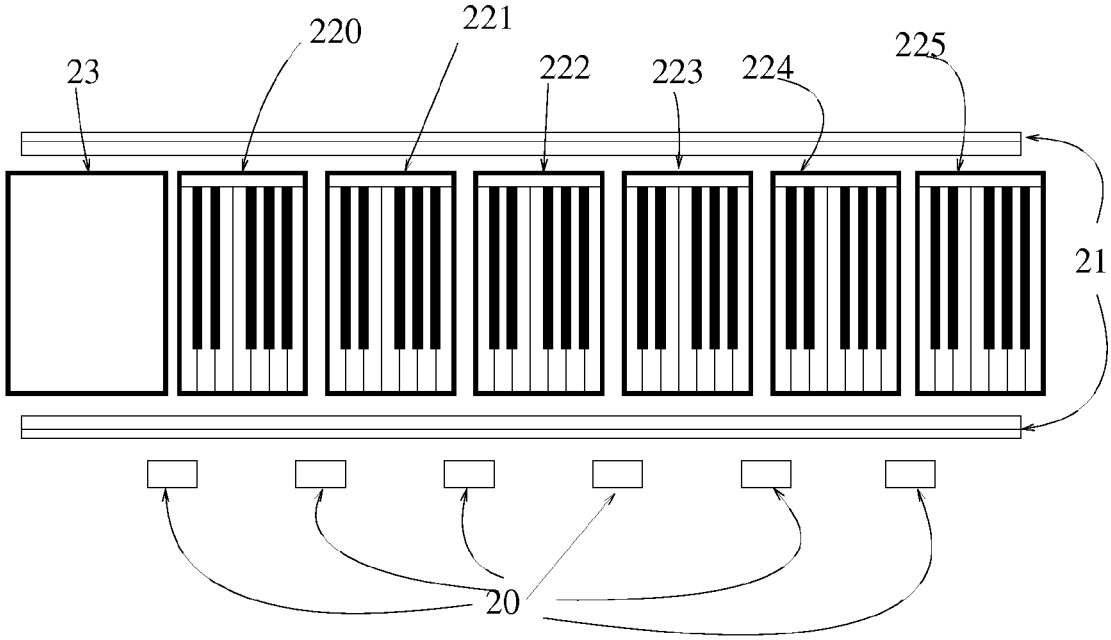
FIG. 4 shows a top view of an embodiment showing the alignment and bus connection parts and how the modules are combined to form a complete keyboard.

FIG. 4 shows some of the various parts that could comprise one keyboard. There are 6 keyboard modules (220, 221, 222, 223, 224, 225) and some functional module (23) these are shown slightly separated from one another and would be joined into a single keyboard by inserting the bus connection parts (20) and the alignment parts (21) followed by pressing the modules together and latching the latches not seen in the top view of FIG. 4. Here we show the two alignment parts as extending the entire keyboard length. They could alternatively be replaced by a larger number of shorter parts that would be fitted into the channels in the modules as shown in FIG. 1. We also show a computer interface (24) connected to a computer (25).

Thus we have described the main embodiment. This embodiment has some additional variation in what additional features might be added to the controller module.

There are other embodiments that one can form by adding other types of modules that connect like the keyboard modules but provide other functionality to the first embodiment. These include computer interfaces, devices for recording and playback of the performance, separate musical tone generators, signal processing, a signal mixer, amplification, speakers, and legs to support the keyboard. Any of these functional modules can be added to the first embodiment to form a new embodiment of the invention.

Figure 5:
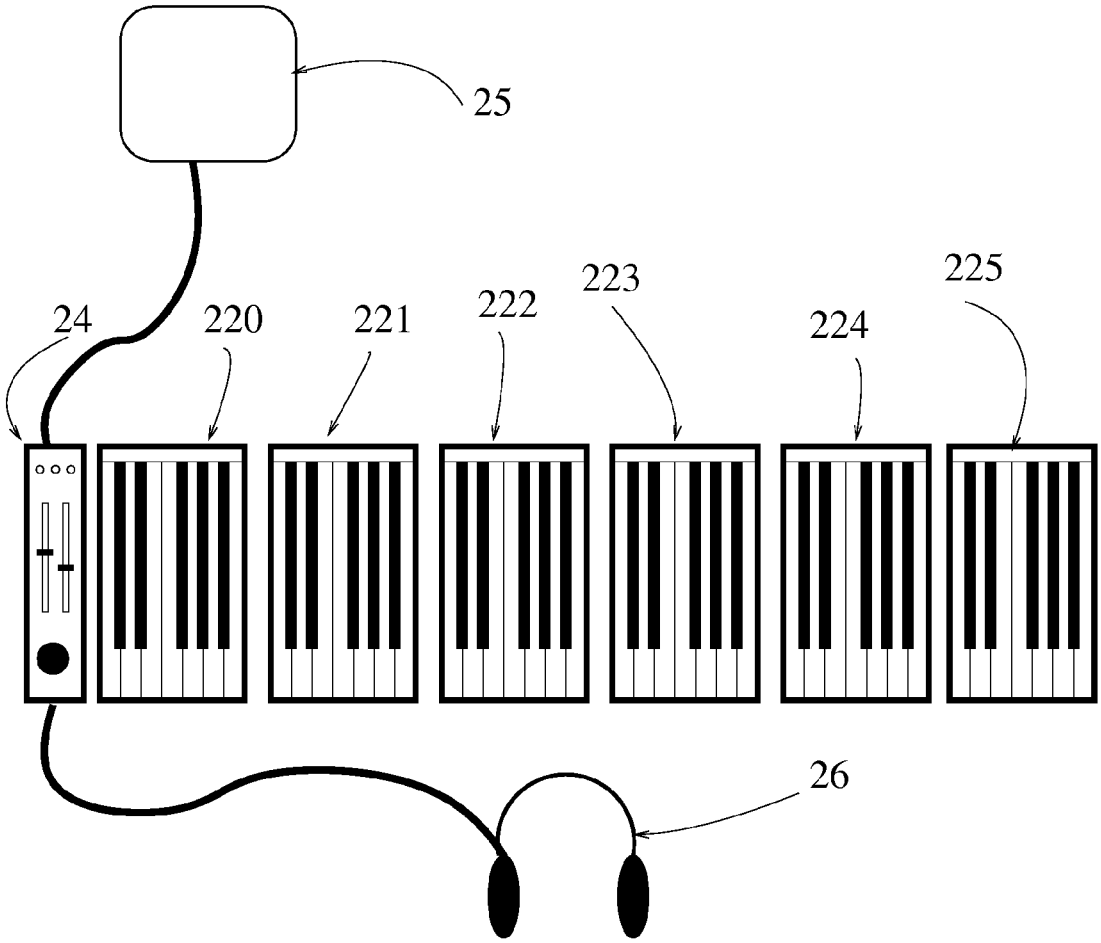
FIG. 5 shows a top view of an embodiment showing a minimal configuration.

So for example in FIG. 5 we show a possible configuration using six keyboard modules (220, 221, 222, 223, 224, 225), a performance controller with a computer interface and headphone jack (24), a computer (25), and a set of headphones (26). The connection to the computer would be used to exchange midi and digital audio allowing the playing of virtual instruments and hearing them via the headphones. We show the modules slightly separated and without the bus connection and alignment parts for clarity.

Figure 6:
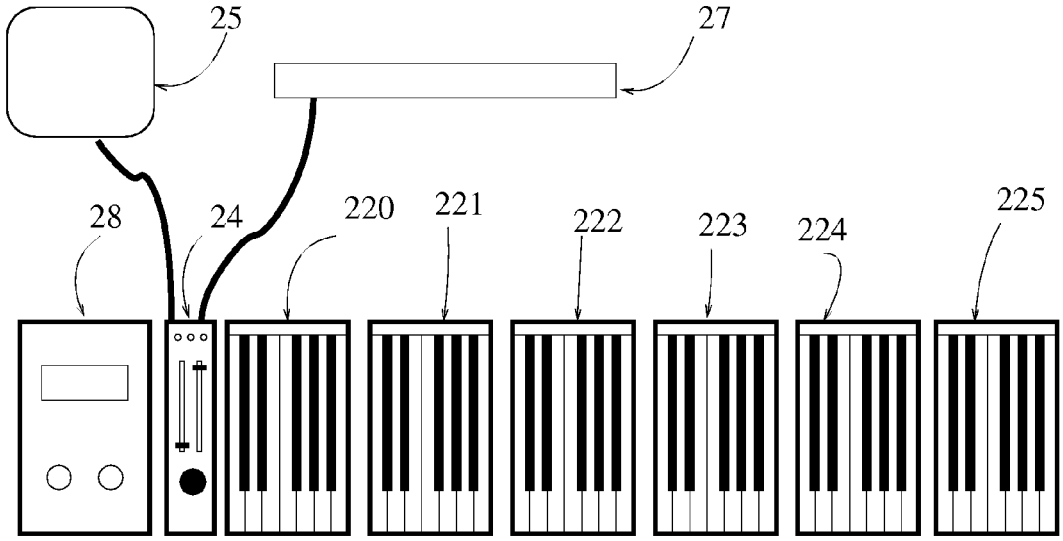
FIG. 6 shows a top view of an embodiment showing two functional modules.

In FIG. 6 we show a possible configuration using six keyboard modules (220, 221, 222, 223, 224, 225), a performance controller with a computer interface (24), a musical tone generator (28), a computer (25), and a rack-mount midi device (27). We show the modules slightly separated and without the bus connection and alignment parts for clarity.

Figure 7:
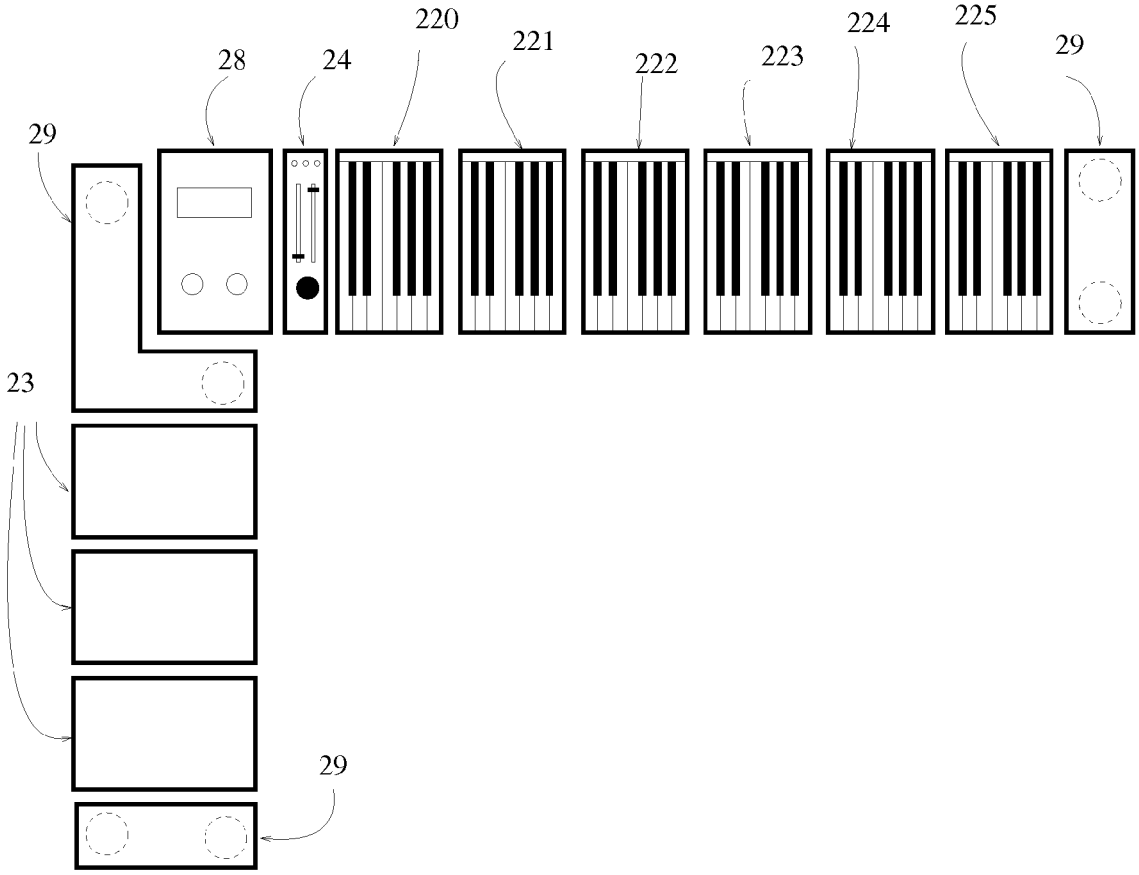
FIG. 7 shows a top view of an embodiment showing 8 functional modules.

In FIG. 7 we show a possible configuration using six keyboard modules (220, 221, 222, 223, 224, 225), a performance controller (24), a musical tone generator (28), three support modules with legs (29), and three other functional modules (23). We show the modules slightly separated and without the bus connection and alignment parts for clarity.

The computer interface would include digital to analog and analog to digital converters. It would have output ports for the converted digital audio and input ports for audio to be converted and sent to the computer. It would contain an interface socket and communicate with the computer via a standard protocol such as a midi, usb, Firewire, USART, Ethernet or other. The computer would be equipped with the needed device driver and allow the use of standard computer music software such as virtual instruments, midi sequencers, digital recording, sampling and others. The computer interface module could be provided with controls that allow easier control of the computer software while seated at the modular keyboard performance system. It could use the data bus to send and receive both audio and performance data to other modules.

A virtual instrument and effects playback module could be added. This would be a modified PC built into a module. It would use flash memory in place of the hard disk and passive cooling in place of the fan. Virtual instruments (such as plugins written using Steinberg's VST) could then be used on stage with the same convenience as a dedicated sound module's patches. An example of the operating system could be 'Windows Embedded' with the addition of a custom virtual instrument playback engine that runs on boot-up and handles the communication with the external computer, the modular keyboard, and the interface panel. The interface panel would be suited to the selection of instrument patches. The unit would boot up very quickly and be ready to play as no hard disk need be read.

A recording and playback module could take a number of forms. It could consist of an audio tape recorder built into a module chassis. Another possibility is a digital recorder ether to tape or a hard disk. Another type of recorder is a midi sequencer built into a module chassis. It could use the data bus to send and receive both audio and performance data to other modules.

A musical tone generator would normally include a number of audio outputs, a user interface with a number or buttons, slider and LCD display features. It might further include midi in/out/thru ports. It could use the data bus to send and receive both audio and performance data to other modules.

A signal processor might add equalization, re-verb, chorus, pitch shift or other digital effects to audio input signals. It would include audio inputs and outputs and a user interface with a number or buttons, slider and LCD display features. It could use the data bus to send and receive both audio and performance data to other modules.

A signal mixer would have a number of audio inputs and outputs. It would allow the combining of audio signal from separate sources. It would include a headphone output and a main stereo mix output. It would have user controls for levels, pan position, and EQ. It would also include insert points and auxiliary mix sends and returns for digital effects boxes and microphone pre-amp stages.

An amplification module would simply amplify low level audio input signals to a higher level suitable for output to either a speaker or headphone.

The leg modules would provide a more attractive end piece to the system as they would need to connect on only one side each. Thus they would only contain one alignment channel opening each.

The term 'audio' is meant to encompass both analog and digital audio. Throughout this Patent Application, certain processing may be depicted in serial, parallel, or other fashion, for ease of description. Actual hardware and software realizations, however, may be varied depending on desired optimizations apparent to one of ordinary skill in the art.

In summary, a goal of the exemplary system is to provide a keyboard performance system that is more portable and is physically strong. A second goal is to provide a data bus connection with reduced width and robust with respect to relative movements between modules while accommodating multiple signals paths for the various system functions. A third goal is to provide a flexible performance system integral to the keyboard where parts can be physically added and taken away. This system should ideally provide the musician with options for any functionality needed during the performance of music on a keyboard. These related goals are achieved by a combinations of related specific aspects of the exemplary system.

We propose a musical performance system comprising a number of separate modules. As the number of these modules is not fixed the musician can acquire the number of modules that give a keyboard of the desired length. The musician can then either run a cable to a rack off stage that provides all other functionality or acquire additional modules to provide additional functionality that is needed on stage. These additional modules all connect and communicate using using a common means and thus form an integrated yet flexible performance system.

A computer interface module can exchange performance information and digital audio with a computer allowing a compact system capable of communicating the output of virtual instruments on the computer to the modular system in response to the transmission of performance data to the computer.

A virtual instruments and effects playback module that simplifies the requirements to playback third party instruments written to be run from a standard general purpose PC. This module will boot faster, run quieter, and take less space than a full PC. It would also be integrated into the keyboard by the standard module connection.

An inter-module communication that can take the form of a data bus in each module. The data bus is connected across the join between two modules via a separate bus connection part to minimize the stresses on the electrical connection. Alternatively a wireless communication path can be used. In the case of a data bus, the data bus can include other lines for powering the modules and for passing other information between the modules. The other information could include a sense of being attached or detached, a write enable token for the communication channel, or audio data.

Our improvement is to separate the functionality into separate optional modules. This will improve the system by allowing the musician to pick and chose the functional modules. There is a considerable variety of functionality that a musician might or might not require on stage and near at hand. Another benefit of a modular performance system is that the musician can carry to a performance only the parts necessary for that performance simplifying the stage rig when possible. In addition the system can be upgraded and augmented without needing to buy a whole new system. The hope is that a wide range of high quality functional modules can be offered by making the module standard open to developers.

Another improvement in the modular system is inclusion of a computer interface that exchanges both performance data and digital audio between the system and a computer as opposed to only including a midi interfaces. The midi standard is a standard for exchanging performance data and does not include digital audio. The primary purpose of a midi interface is the triggering of notes on a separate synthesizer. The standard is of too low a speed to send digital audio over and so no provision for digital audio exists in the midi specifications. The inclusion of a computer interface with digital audio is important for using the keyboard without any sound generator as the keyboard can send performance data to the computer which can then send digital sound to the keyboard allowing a wide variety of virtual instruments to be used. We see a portable, inexpensive, and flexible configuration as the keyboard modules, a computer interface module with headphone jack, a laptop computer, and a set of headphones. This would allow a system that can even be carried on an airplane and then set up and played in a hotel room as one scenario.

As an improved alternative to the computer interface is to build a modified version of the general purpose PC into a module. This module could then playback virtual instruments written for a PC without the need for the PC screen, keyboard, disk, and fan. These sounds could then be accessed by patch change messages as on any other synthesiser. The combined keyboard and virtual instrument playback module would form an integrated system. It would operate at gigs as a virtual instrument playing synth with a simple interface. The availabilty of sound plugins for virtual instruments for a PC far exceeds any hardware synth's timbre selection.

Another feature of the exemplary system is the use of separate bus connection parts for electrically connecting the data bus between adjacent modules. The method of having a separate part allows a relative displacement between the modules to be distributed along the length of the bus connection part which is free to rock at at both ends. This puts dramatically lower stress on the connection. The use of a data bus with a direct electric connection is part of the preferred embodiment and has the advantage over other types of signal transfer as the modules can share power and signal ground over this bus. It is of course important to not allow any other signal ground path. Thus the entire system can have a common signal ground path and power input. It also allows the use of a number of lines dedicated to different functions important to the performance system. Thus for instance lines can be dedicated to performance data, token passing, power, ground and audio signals. This allows the modules to ignore those bus lines not important for their functions.

The separate parts illustrated above are removably connectable, to form rigid structure, without requiring tools.

Figure 8:
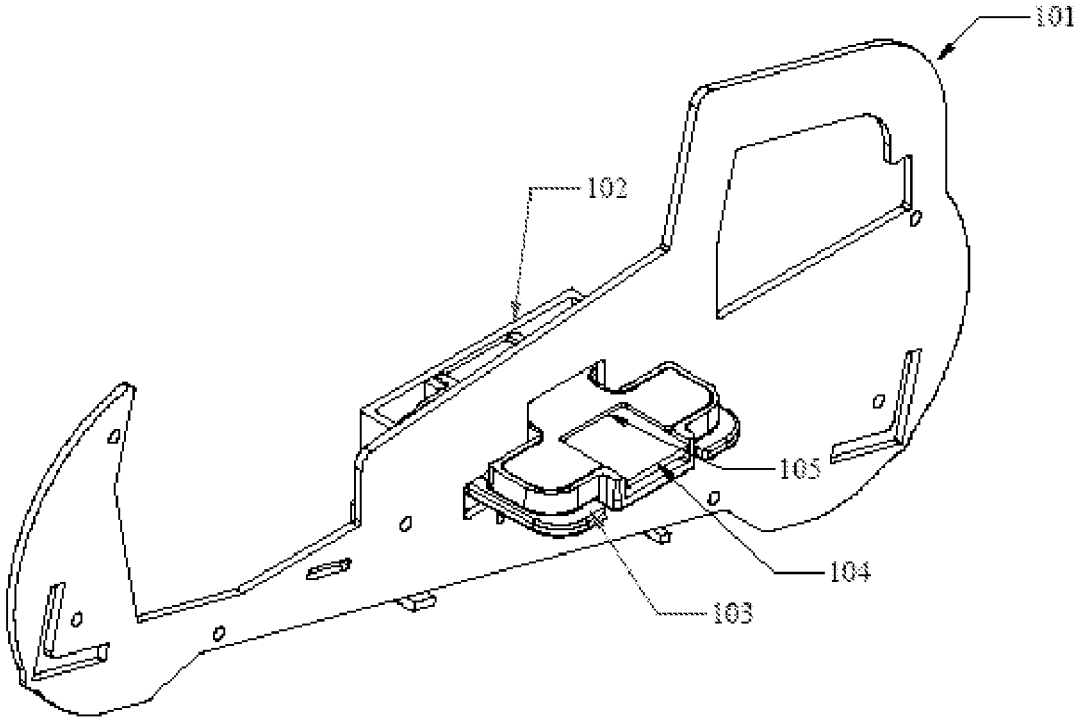
FIG. 8 shows a prospective view of an embodiment of the connection assembly that holds the modules together.
Figure 9:
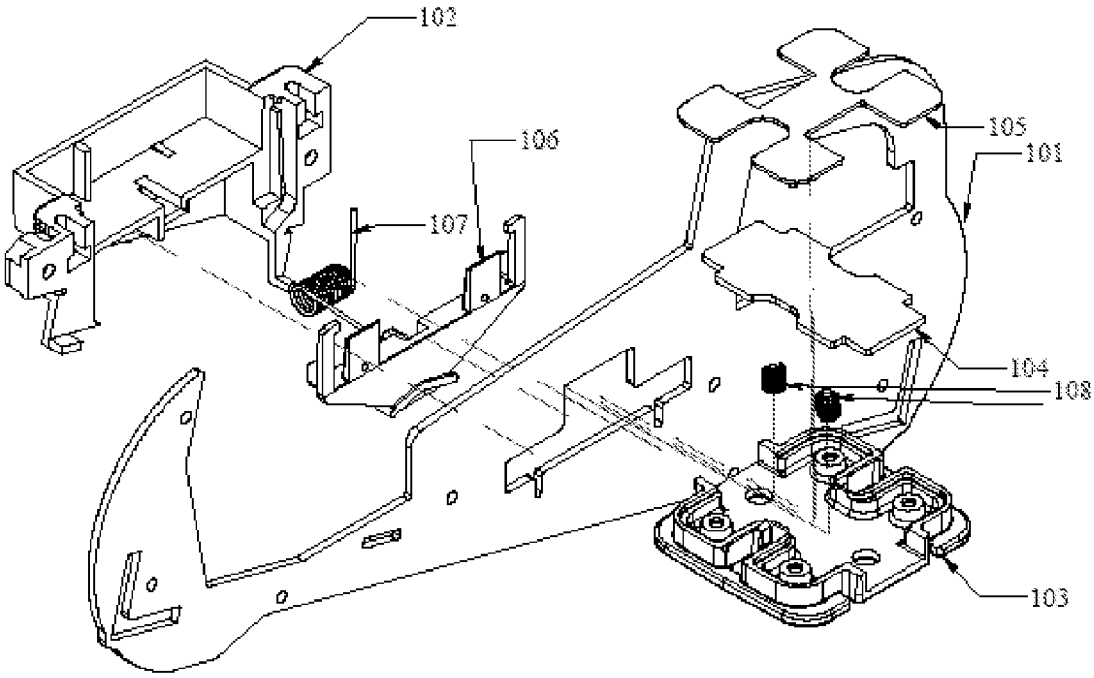
FIG. 9 shows an exploded view of the connection assembly of FIG. 8.
Figure 10:
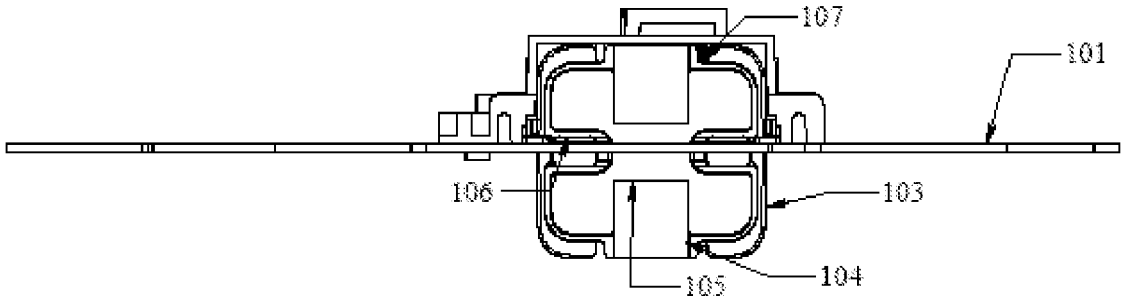
FIG. 10 shows a top view of the connection assembly of FIG. 8.

FIGS. 8-10 show an embodiment of the connection part that both joins the data buses of two modules and holds the modules together tightly. The modules themselves are not shown here for clarity. An end plate (101) would be firmly mounted to each module with the end plates of two adjacent modules being pressed together by the connector. The separate connection part 103 slides into openings in the endplates and when completely inserted into both modules is pressed upwards by the springs (107) (only one spring shown the second being in the adjacent module). The springs (107) also pushes the double wedges (106) up through the two rectangular holes in the connector. There is a wedge in each module and the two wedges serve to press the end plates together. Notice that the connection part must be fully inserted into both modules before being free to move upwards.

Printed circuit board (PCB) (104) provides the electronic path between the two modules. This PCB will have traces connecting conductive pads on each side. The pads are pressed to copper contacts in each module when the connector part (103) is pressed upwards by the spring (107). The two additional springs (108) allow the PCB (104) to be compliant to small relative movements of the two modules. Thus the electrical connection is not directly stressed by such movements.

Connection housing (102) can be attached to the end plate (101) by screws. The connection part has a cover (105) to prevent the PCB (1040 from falling out of the connector part.

The use of this connection assembly has a number of advantages. First, it does not add to the length of the modules during transport. The modules are as short as possible making them fit more easily into a case or bag. Second, the electronic connection is compliant with no stress placed on the electrical connection. Third, the signal path is on a printed circuit board and thus there is very little signal degradation. And forth, the connection part (103) can be made to be the weakest part of the connection so that excessive stress causes it to fail before any parts internal to the modules fail. Thus an inexpensive part can be replaced with a spare in that situation.

In this Patent Application, the word circuitry encompasses dedicated hardware, and/or programmable hardware, such as a central processing unit (CPU) or reconfigurable logic array, in combination with programming data, such as sequentially fetched CPU instructions or programming data for a reconfigurable array. Thus, circuitry encompasses, for example, a general-purpose electronic processor programmed with software, acting to carry out a described function.

Benefits, other advantages, and solutions to problems have been described above with regard to specific examples. The benefits, advantages, solutions to problems, and any element (s) that may cause any benefit, advantage, or solution to occur or become more pronounced are not critical, required, or essential feature or element of any of the claims.

Additional advantages and modifications will readily occur to those skilled in the art. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims. In general, the words "first," "second," etc., employed in the claims do not necessarily denote an order.

What is claimed is:

1. A modular musical performance system, comprising:

a plurality of first modules, each first module including a plurality of keys;

a plurality of key switches that operate in response to the striking and releasing of the keys, wherein an arrangement of the keys is such that when connected to another first module the keys of the two modules form a section of a continuous music keyboard;

a switch array bus including address lines and data lines each line being connected to a switch such that each switch is attached between only one data line and one address line and no data line is connected to the same address line via two different switches;

an element that polls the switch array bus and converts switch closing information into coded messages sent to an adjacent module; and a plurality of second modules, each second module including a component selected from the group consisting of a performance controller, a computer interface, a musical tone generator, a musical accompaniment, a speaker, a performance recorder, an audio amplifier, an audio mixer, an audio processor, and a support extending to the floor, wherein the first and second modules are irremovably connectable to form a single rigid structure.

2. A modular musical performance system, comprising:

a computer interface that exchanges both performance data and digital audio between the system and a computer; and a plurality of first modules, each first module including a plurality of keys;

a plurality of key switches that operate in response to the striking and releasing of the keys;

a switch array bus including address lines and data lines each line being connected to a switch such that each switch is attached between only one data line and one address line and no data line is connected to the same address line via two different switches;

an element that polls the switch array bus and converts switch closing information into coded messages sent to an adjacent module;

wherein an arrangement of the keys is such that when connected to another first module the keys of the two modules form a section of a continuous music keyboard, wherein the first modules are irremovably connectable to form a single rigid structure.

3. A modular musical performance system, comprising:

a plurality of physically separable modules that connect to form a single rigid structure;

a means for communication between the modules;

the modules comprising:

a plurality of separate alignment parts that slide into channels extending into each of the modules from the ends that face an adjacent module;

a virtual instruments and effects module that can allow the use of Virtual Studio Technology (VST) plug-ins as part of the musical performance system;

a plurality of keyboard modules each of which is a module comprising:

a plurality of keys along the module's length;

a plurality of key switches that operate in response to the striking and releasing of the individual keys;

an arrangement of mounting the keys such that when connected to another keyboard module the keys of the two modules form a section of a continuous music keyboard;

a switch array bus including address lines and data lines each line being connected to a switch such that each switch is attached between exactly one data line and one address line and no data line is connected to the same address line via two different switches; and an active electronic processing element that polls the switch array bus and converts the switch closing information into coded messages sent to an adjacent module using the means for communication.

* * * * *